United States Patent [19]

Nothdurft

[11] Patent Number: 4,541,789

[45] Date of Patent: Sep. 17, 1985

[54] FUEL INJECTION PUMP FOR INTERNAL COMBUSTION ENGINES

[75] Inventor: Heinz Nothdurft, Stuttgart, Fed. Rep. of Germany

[73] Assignee: Robert Bosch GmbH, Stuttgart, Fed. Rep. of Germany

[21] Appl. No.: 644,123

[22] Filed: Aug. 23, 1984

[30] Foreign Application Priority Data

Sep. 22, 1983 [DE] Fed. Rep. of Germany ..... 3334199

[51] Int. Cl.[4] ..... F02M 41/12

[52] U.S. Cl. ..... 417/498; 417/289; 417/500; 123/449

[58] Field of Search ..... 417/289, 498, 500, 499; 123/449, 458, 503

[56] References Cited

U.S. PATENT DOCUMENTS 4,059,369 11/1977 Eheim ..... 417/474
4,065,236 12/1977 Hofer et al. ..... 417/500 X

FOREIGN PATENT DOCUMENTS 2449332 4/1976 Fed. Rep. of Germany ..... 417/499
493422 10/1938 United Kingdom ..... 123/449
2109476 6/1983 United Kingdom ..... 123/449

*Primary Examiner*—Richard E. Gluck
*Attorney, Agent, or Firm*—Michael J. Striker

[57] ABSTRACT

A fuel injection pump for supplying fuel to the cylinders of the internal combustion engine comprises a housing, a cylindrical sleeve inserted in the housing and provided with a single filling opening communicated with a fuel-feeding passage, and a piston rotatably and reciprocally slidable in the cylindrical sleeve. An end face of the piston encloses with the closing element of the pump a pump operation chamber which is filled with fuel from the filling opening through a number of longitudinal grooves formed in the piston. The longitudinal grooves are in communication with a central relief opening by means of a plurality of radial connecting passages formed in the piston.

2 Claims, 1 Drawing Figure

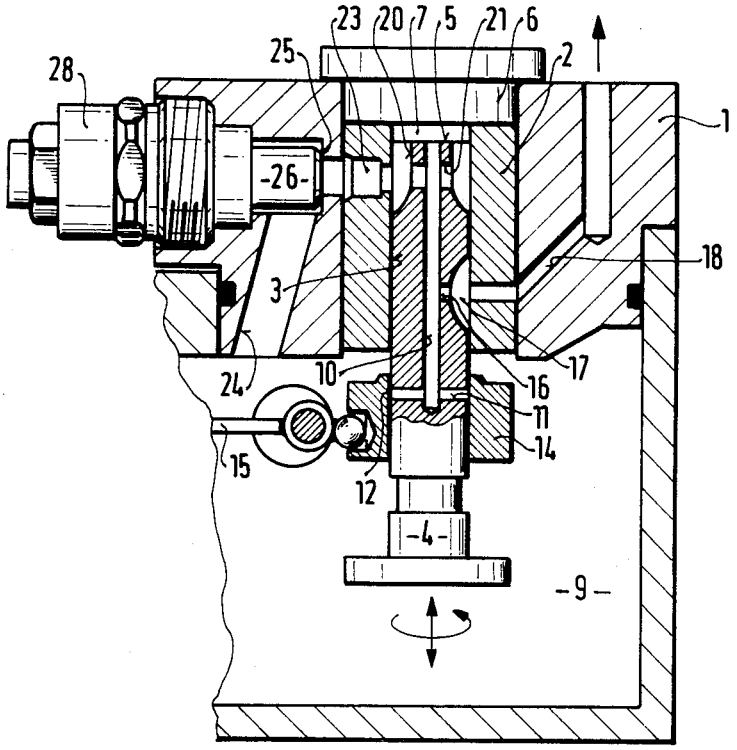
23
20
7
5
21
6
25
2
28
1
-26-
18
3
17
24
10
16
11
14
15
12
-4-
-9-

FUEL INJECTION PUMP FOR INTERNAL COMBUSTION ENGINES

BACKGROUND OF THE INVENTION

The present invention pertains to fuel injection pumps. Fuel injection pumps are well known for supplying fuel to the cylinders of an internal combustion engine.

Conventional fuel injection pumps of the type under discussion include a housing in which a cylinder is inserted, guiding in the interior thereof a reciprocally movable and rotational piston which operates as a fuel distributor. The lower end of the piston extends into the pumps suction chamber while its upper end face together with the closing member encloses a pump operation chamber.

German patent publication DE-OS No. 2,503,300 discloses a fuel distributor injection pump, in which the pump piston is arranged in the interior of the cylindrical sleeve or bush. This sleeve at the outer periphery thereof is formed with a partially circular groove, through which a fuel supply passage, opened into that groove and closable by an electromagnetically actuated shut-off valve member, is connected simultaneously with a plurality of fuel-filling openings which open into the interior of the sleeve. The arrangement of these filling openings corresponds to a uniform distribution of the longitudinal grooves provided in the pump piston. In order to maintain the dead volume spaces between the valve-closing member in the fuel supply passage and the mouth of each filling opening in the cylindrical sleeve as small as possible the partially circular groove extends up to two or three filling openings. The above mentioned German patent corresponds to U.S. Pat. No. 4,059,369, the entire disclosure of which is incorporated herein by reference.

It has been known that the presence of a dead space is particularly disadvantageous in respect to the dosing control of the amounts of the injected fuel when this dead space is large in relation to the injected amount of fuel. A specifically disadvantageous effect occurs at the low number of revolutions of the motor. However, it has been required that the smallest possible fluctuations be allowed to obtain a low-roughness running of the internal combustion engine and a favorable exhaust gas composition. In the mostly fast-running self-igniting internal combustion engines (diesels) at the present time, the opening cross-section formed between the fuel supply line and the pump operation chamber in the fuel injection pump, operated at a high number of revolutions, must be during the suction cycle, as large as possible so that with only short suction cycles a sufficiently large opening cross-section would be available, which would ensure a sufficient filling of the pump operation chamber with fuel. Therefore in the known device a plurality of filling openings are provided, which are connected to each other by the partially circular groove.

In the distributor fuel-injection pumps, which with the aid of the valve provided in the fuel supply passage must be set to a zero-feed position so that the internal combustion engine is brought to a standstill, the dead space has a negative effect specifically when one deals with the distributor fuel-injecting pump which serves to supply fuel to five or more cylinders of the internal combustion engine. A reliable shut-down of the internal combustion engine of the above-described conventional construction is then impossible.

SUMMARY OF THE INVENTION

It is an object of the present invention to provide an improved fuel injection pump for an internal combustion engine.

This and other objects of the invention are attained by a fuel injection pump for an internal combustion engine, comprising a housing; a cylindrical means in said housing and having an interior; a distributor piston reciprocally axially and rotationally movable in said cylindrical means; said piston having an end face which encloses in the interior of said cylindrical means a pump operation chamber, said piston being formed with a relief passage extended from said end face inwardly of the piston, with a distributor opening communicating with said relief passage and opening at an outer surface of said piston, and with a plurality of elongated grooves forming on the outer surface of the piston control surfaces and being opened into said pump operation chamber, said housing including a pump suction chamber, a fuel feeding passage communicating with said suction chamber, and a plurality of fuel conveying passages which extend through said piston and open into the interior of said cylindrical means, the number and the arrangement of said fuel conveying passages corresponding to the number and distribution of the cylinders of the internal combustion engine to be supplied with fuel, said pump operation chamber upon the axial movement of said piston during a fuel supply stroke being placed in communication through said relief passage and said distributor opening with a respective one of said fuel conveying passages and with said control surfaces; a shut-off member positioned in said fuel feeding passage for interrupting the feed of fuel into the pump, one of said elongated grooves being placed into communication with said fuel feeding passage during the fuel supply stroke, the number and the arrangement of said elongated grooves corresponding to the number and the arrangement of said fuel conveying passages, said piston being formed with a plurality of radial connecting passages such that each radial connecting passage connects each elongated groove with said relief passage, said piston being further provided with a single filling opening formed in said cylindrical means and opening into the interior of said cylindrical means, said fuel passage being connected with said filling opening.

The cylindrical means may be a cylindrical sleeve inserted into said housing.

The main advantage of the fuel injection pump according to the present invention resides in that, due to the reduction of the number of the filling openings to a single one, the dead volume space between the valve member positioned in the fuel supply passage and the filling opening is reduced
to be very small so that the shut-down safety of the internal combustion engine upon the closing of the valve-closing member, due to a small dead space, is improved. An enlarged connection area or cross-section between the filling opening and the pump operation chamber is at the same time provided because fuel flows not only through a single elongated groove or three elongated grooves, as is the case in the conventional construction, but through all elongated grooves and the relief passage.

A further advantage of the fuel injection pump of the present invention is that the pump body is uniformly constructed in the region of the fuel feeding independently from the construction of the pump piston or from the number of the fuel injection lines. This is advantageous specifically for the pumps in which the cylindrical sleeve for forming a pump operation chamber is utilized.

Still another advantage of the present invention resides in that the fuel stream flowing from the filling opening is divided into one stream directed along the axis of the pump piston and other radial streams guided in the radial connecting passages. Thereby wear due to cavitation, which may occur at the edges limiting the filling opening at the side of the pump operation chamber, would be prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

The single FIGURE of the drawing illustrates a sectional view through a fuel injection pump according to the invention.

DETAILED DESCRIPTION OF THE PREFERRED EMBODIMENT

Referring now to the drawing in detail, reference numeral 1 designates a housing of a distributor fuel-injection pump. A cylindrical body or sleeve 2 has a cylindrical interior 3 in which a pump piston 4 is slidably guided. The injection pump shown herein is adapted to supply fuel to a multi-cylinder internal combustion engine. The end face 5 of the pump piston together with an enclosing member 6 encloses a pump operation chamber 7 within the interior 3 of cylindrical sleeve 2. The opposite end of the pump piston 4 extends into a suction chamber 9 of the fuel injection pump, suction chamber 9 being supplied with fuel by non-illustrated conventional means.

A conventional pump drive means, which is not shown in the drawing, and which is adapted to reciprocally move and simultaneously rotate the pump piston, is provided on the lower end of the pump piston whereby the piston serves simultaneously as a distributor.

An axial blind bore 10, which forms a relief passage, extends in the pump piston 4 from its end face 5 into the interior of the piston, this relief passage 10 merging into radial bores 11. The radial bores 11 in turn open at that portion of the piston 4 which extends into the suction chamber 9 while the discharge openings 12 of said bores 11 are controlled via a cylindrical slide 14 which is fluid-tightly displaceable on the piston 4. The annular slide 14 is moved by means of a conventional non-illustrated governor unit though an adjusting lever 15. In dependence upon an axial position of the slide 14 a stroke of the piston is adjusted at which that discharge openings 12 become opened during the pump stroke of the piston 4, thereby establishing a connection between the pump operation chamber 7 and pump suction chamber 9 and interrupting the fuel discharge from the pump operation chamber to the internal combustion engine.

A radial bore 16 branches from the relief passage 10, bore 16 merging into a distributor groove 17. The latter communicates with fuel conveying or discharge passages 18 which open into the interior 3 of the cylindrical sleeve 2; discharge passages 18 being arranged at the peripheral cylindrical surface 3 in the region of distributor groove 17 in accordance with the number and the distribution of the cylinders of the internal combustion engine supplied with fuel from the fuel injection pump.

The fuel supply of the pump operation chamber 7 is effected through longitudinal grooves 20 which are arranged on the periphery of the piston 4 and extend from the end face thereof; the number and the distribution of grooves 20 on the outer periphery of piston 4 corresponds to the number of fuel injection passages or suction/or feeding strokes of the pump piston. Radial connecting passages 21 extend between the grooves 20 and the relief passage 10 so that all longitudinal grooves 20 are connected to each other via these radial connecting passages. The longitudinal grooves 20 will hence be called elongated grooves 20.

The elongated grooves 20 communicate with a single filling opening 23, which opens into the interior 3 of sleeve 2 and is in communication with a fuel feeding passage 24 which branches from the pump suction chamber 9. A valve seat 25 is formed in the fuel feeding passage 24, which valve seat forms the opposite member of a valve-closing member 26. The latter is actuated in the known fashion by an electromagnet 28 and serves the purpose of closing the fuel feeding or fuel supply passage 24 to interrupt the fuel supply into the pump operation chamber 7.

In operation when the fuel feeding passage 24 is open and during the suction stroke of piston 4 the filling opening 23 is brought into communication with one of the elongated grooves 20 upon the rotation of the piston 4 so that the fuel can flow into this elongated groove and then through the radial bores 21 into all other elongated grooves 20. The fuel from these grooves flows then into the pump operation chamber 7 which is simultaneously supplied with fuel from the relief passage 10. Therefore a very large fuel-filling area or cross-section is available so that the pump operation chamber 7 can be completely filled with fuel very fast even at a high number of revolutions. Upon the shutting down of the pump operation with the aid of the valve closing member 26 only a small dead space remains in the region between the valve seat 25 and the filling opening 23, which effectively makes available only very small fuel volumes out of the difference of the pressure levels in said space established on the one hand by a maximal underpressure at the lowermost dead point of the pump piston during the suction stroke and on the other hand by the balanced-out condition when the pump operation chamber is connected via the relief passage 10 to the suction chamber 9.

It will be understood that each of the elements described above, or two or more together, may also find a useful application in other types of fuel injection pumps for internal combustion engines differing from the types described above.

While the invention has been illustrated and described as embodied in a fuel injection pump for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a fuel injection pump for an internal combustion engine, comprising a housing; a cylindrical means disposed in said housing and having an interior; a distributor pump piston reciprocally axially and rotationally movable in said cylindrical means; said piston having an end face which encloses in the interior of said cylindrical means a pump operation chamber, said piston being formed with a relief passage extended from said end face inwardly of the piston, with a distributor opening communicating with said relief passage and opening at an outer surface of said piston, and with a plurality of elongated grooves forming on the outer surface of the piston control surfaces and opening into said pump operation chamber, said housing including a pump suction chamber, a fuel feeding passage communicating with said suction chamber, and said interior of said cylindrical means and a plurality of fuel conveying passages which extend through said housing and open into the interior of said cylindrical means, the number and the arrangement of said fuel conveying passages corresponding to the number and distribution of the cylinders of the internal combustion engine to be supplied with fuel, said pump operation chamber upon the axial and rotational movement of said piston during a fuel pump stroke being placed in communication through said relief passage and said distributor opening with a respective one of said fuel conveying passages and shut-off member positioned in said fuel feeding passage for interrupting the feed of fuel to the pump operation chamber and one of said elongated grooves being placed into communication with said fuel feeding passage during the fuel suction stroke of the pump piston, the number and the arrangement of said elongated grooves corresponding to the number and the arrangement of said fuel conveying passages, the improvement comprising a plurality of radial connecting passages formed in said piston such that each of said radial connecting passage connects one of said elongated grooves with said relief passage; and said fuel feeding passage having a single filling opening formed in said cylindrical means and being open at the interior of said cylindrical means.

2. The fuel injection pump as defined in claim 1, wherein said cylindrical means is a cylindrical sleeve inserted into said housing.

* * * * *